United States Patent [19]

Tönshoff et al.

[11] Patent Number: 4,799,472

[45] Date of Patent: Jan. 24, 1989

[54] METHOD OF AND ARRANGEMENT FOR DRESSING GRINDING WHEELS

[75] Inventors: Hans K. Tönshoff, Burgwedel; Thomas Grabher, Hanover; Harald Gosebruch, Hanover; Jürgen Jendryschik, Hanover, all of Fed. Rep. of Germany

[73] Assignee: Ernst Winter & Sohn (GmbH & Co.), Hamburg, Fed. Rep. of Germany

[21] Appl. No.: 87,687

[22] Filed: Aug. 19, 1987

[30] Foreign Application Priority Data

Aug. 19, 1986 [DE] Fed. Rep. of Germany ..... 3628143

[51] Int. Cl.[4] ..... B24B 53/053

[52] U.S. Cl. ..... 125/11 R; 125/11 CD; 125/11 CW; 51/165 R

[58] Field of Search ..... 125/11 R, 11 CD, 11 CW; 51/165 R, 165, 77

[56] References Cited

U.S. PATENT DOCUMENTS 4,199,902 4/1980 Saverland ..... 51/165 R 4,566,426 1/1986 Schleich et al. ..... 125/11 R

*Primary Examiner*—Robert P. Olszewski

*Assistant Examiner*—Maurina Rachuba

*Attorney, Agent, or Firm*—Michael J. Striker

[57] ABSTRACT

Dressing of grinding wheels is performed by a dressing tool which is displaced first to be brought into contact with a grinding wheel and the contact is determined by measuring an electrical voltage of a piezoelectric element connected with the dressing tool, and then feeding of the dressing tool relative to the grinding wheel for dressing is performed by applying an electrical voltage to the piezoelectric element.

7 Claims, 1 Drawing Sheet

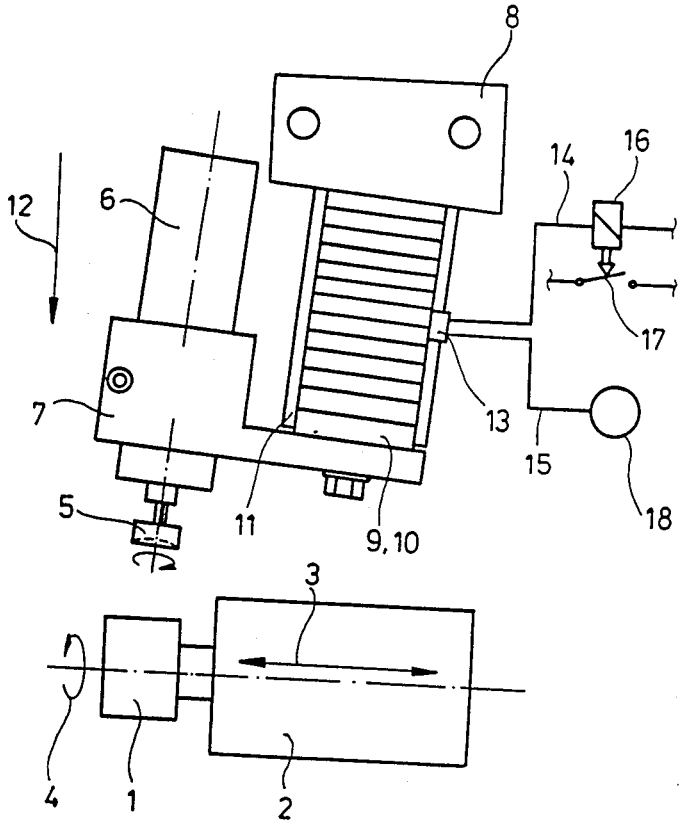
8
14
16
12
6
17
7
13
15
18
5
11
9,10
3
4
1
2

METHOD OF AND ARRANGEMENT FOR DRESSING GRINDING WHEELS

BACKGROUND OF THE INVENTION

The present invention relates to a method of and arrangement for dressing (truing) of grinding wheels with diamond or cubic crystalline boron nitride as grinding material, by means of a diamond dressing tool. More particularly, it relates to such a method and an arrangement in which a diamond dressing tool is connected with a movable machine carriage which has an adjustable feeding speed.

It is known to utilize an electromechanical drive unit for feeding a dressing tool. A NC control or a CNC control can be used for these purposes. Such devices are relatively expensive. Its substantial disadvantage is also that the feeding cannot be performed in many cases as accurately as desired as a result of errors which are produced by mechanical friction and also an insufficient rigidity of the drive system. Moreover, thermal effects such as for example temperature increase in the working space or temperature fluctuations of the grinding disk also undesirably affect the accuracy of the feeding. Since the grinding disk expands during its use as a result of its heating, therefore for a new dressing step it is located after its return to the dressing position in a different location, as compared with the location in which it was initially dressed under lower temperature. Therefore the preliminary developed value for the adjustment of the dressing tool is not reproducible. In the grinding technique there is a requirement to make possible such dressing feed which is reproducible with values lower than 2 micrometer. What is understood here as a dressing feed is the feeding of a dressing tool per each dressing step. If a total dressing feed amounts to 2 micrometers, it is advantageous when this value is subdivided into several individual feeding steps of smaller value, such as for example 4 individual feeding steps each equal 0.5 micrometer. In this approach significantly improved dressing feed can be obtained than in the event of a greater feed. In practice, however, these approaches have not been implemented since the system of cooperation between the grinding wheel and the dressing tool continuously changes especially as a result of deformations which are caused by thermal forces. A dressing output which must be reproducible presumes the exact knowledge of the spatial arrangement between the grinding wheel and the dressing tool, as well as the utilization of a feeding system with highest possible positioning accuracy. What is understood here under the reproducibility is that it must be continuously guaranteed that the same action is produced at different outside conditions during dressing as in the predetermined initial dressing steps.

SUMMARY OF THE INVENTION

Accordingly, it is an object of the present invention to provide a method of and an arrangement for dressing of grinding wheels, which eliminates the disadvantages of the prior art.

More particularly, it is an object of the present invention to provide a method of and an arrangement for dressing grinding wheels, which guarantee reproducible results with maximum accuracy.

In keeping with these objects and with others which will become apparent hereinafter, one feature of the present invention resides, briefly stated, in that a contact between a dressing tool and a grinding wheel to be dressed is determined by measuring an electrical voltage of a piezoelectric element connected with the dressing tool, and then the value of a further feeding of the dressing tool (after stoppage of the machine carriage) is determined by applying a predetermined electrical voltage of the piezoelectric element such that the value of the further feeding of the dressing tool is proportional to the applied electrical voltage.

When the method is performed and the arrangement is designed in accordance with the present invention, it eliminates the disadvantages of the prior art and attains the objects which are specified hereinabove.

The present invention utilizes two known piezoelectric effects, one of these effects is that when a piezoelectric material is subjected to a mechanical loading by outer forces, it produces an electrical voltage which is proportional to these forces. The other effect is that by applying an electrical voltage to a piezoelectric crystal or a ceramic, it expands. The first effect is used to determine the position of the dressing tool when it is brought into contact with the grinding wheel, while the second effect is used for producing a further feed of the dressing tool after reaching the contact position, for performing the dressing process itself. This further feeding or dressing feeding is independent from outer influences, such as insufficient rigidity of the drive device or temperature fluctuations.

In the present invention it is possible to use the phenomenon that with the utilization of a plurality of piezoelectric elements arranged in a stack such as quartz crystals or ceramics, expansions and therefore feeding values of several hundredth mm can be achieved. In the inventive piezoelectric sensor and feed system, one or several stacks of piezoelectric ceramics or crystals can be used in the force flux between the dressing tool and the machine carriage or machine frame, without high expenses. Therefore, the control of the feed of big and heavy dressing tools, such as profile dressing tools, can be performed with highest accuracy and with the use of previously produced results. For the dressing process proper the position of the machine carriage must no longer be changed since its position by the time of contact of the dressing tool with the grinding disk exactly fixes the system of cooperation between these both parts, and then the dressing feed is performed by application of an electrical voltage to the piezoelement with values which correspond to the expansion of the piezoelement. Thereby several advantages are achieved.

The piezoelement makes possible the production of substantially smaller feed values than conventional electromechanical feeding systems. The reproducibility of the feeding values is higher than in the conventional feeding systems, since the piezoelements can be directly coupled with the dressing tool. Therefore the position error which results from insufficient rigidity of a feeding system or guiding and driving conditions does not have any influence upon the results of dressing and the machine dressing carriage does not have to be moved.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The single FIGURE of the drawings is a view schematically showing an arrangement for dressing grinding wheels by a dressing tool.

DESCRIPTION OF A PREFERRED EMBODIMENT

An arrangement for dressing grinding wheels in accordance with the present invention is shown in the drawing and has a grinding wheel 1 with a grinding spindle 2 which is reciprocably movable in correspondence with the double arrow 3. The grinding wheel 1 rotates in correspondence with the arrow 4.

For dressing (truing) of the grinding wheel 1, a diamond cup wheel 5 is provided. It is connected with a drive spindle 6 which has an axis inclinedly adjusted to the axis of the grinding wheel 1.

The dressing wheel 5 is connected via a holder 7 with a mounting plate 8. The mounting plate 8 is a component of an adjustable machine carriage. The connection is performed by a stack 10 of individual piezoelements 9. They can be composed of disk-shaped piezocrystals, for example quartz crystals. The individual piezoelements 9 are accommodated in a housing 11 which is provided with a connection 13 for two conductors 14 and 15.

The feeding of the dressing tool 5 before the beginning of the dressing process is performed via the carriage 8 in the direction of the arrow 12. When a contact is established between the dressing tool 5 and the grinding disk 1, a pressure is built on the piezoelements 9 which are arranged in the force flux between the dressing tool 5 and the carriage 8 which carries the latter. An electrical voltage is produced as a result of this pressure. This electrical voltage is transmitted via the conductor 14 to a relay switch 16. The relay switch 16 opens a switch 17 in response to first occurrence of a voltage thereby interrupts the feeding of the carriage 8 or its adjustment. Directly after this or simultaneously, a voltage can be applied from outside to the piezoelements 9 via a voltage source 18 and the conductor 15. It causes their expansion in reverse to the abovedescribed piezoeffect. The value of this expansion corresponds to the further feeding of the dressing tool and is exactly determined in the correspondence with the value of the applied voltage. It should be emphasized that the operation is performed with a high voltage in the order of maximum approximately 5,000 volts.

The arrangement permits performing for example a total dressing feed of 2 micrometers in four individual feeding steps each in the order of respectively 0.5 micrometer, during which the grinding wheel 1 reciprocates in correspondence with the double arrow 3. Therefore, the loading of the dressing tool and the grinding wheel 1 remains relatively small.

It is to be understood that other diamond tools can be used as the dressing tool 5, both rotatable dressing tools and also stationary diamond tools for example individual diamonds There is for example a possibility to work also a profiled (shaped) grinding wheels with an individual dressing diamond which is controlled via CNC control in correspondence with the course of the profile of tee grinding wheel. The pressure produced from the respectively applied voltage can be continuously maintained so that it is proportional to the amount of feeding. For this purpose the axis of the dressing spindle 6 is arranged perpendicularly to the axis of the grinding spindle 2. When bigger or heavier dressing tools are used, several stacks 10 of piezoelements can be for example used between the holder 7 and its support 8.

It will be understood that each of the elements described above, or two or more together, may also find a useful application in other types of constructions differing from the types described above.

While the invention has been illustrated and described as embodied in a method of and arrangement for dressing grinding wheels, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristic of the generic or specific aspects of this invention.

What is claimed as new and desired to be protected by Letters Patent is set forth in the appended claims:

1. A method of dressing of grinding wheels with diamond or cubic crystalline boron nitride as grinding material, by means of a diamond tool connected with a piezoelectric element, comprising the steps of bringing a dressing tool in contact with a grinding wheel to be dressed; determining the contact between the dressing tool and the diamond wheel by measuring an electrical voltage of the piezoelectric element; stopping the dressing tool after establishing the contact between the dressing tool and the grinding wheel; and feeding the dressing tool after the stopping by applying an electrical voltage to the piezoelectric element and with a value corresponding to the applied electrical voltage.

2. A method as defined in claim 1, wherein said bringing includes bringing into contact the dressing tool which is connected with a movable machine carriage, said stopping including stopping the machine carriage and therefore the dressing tool.

3. A method as defined in claim 1, wherein said feeding includes feeding the dressing tool by applying the electrical voltage to the piezoelectric element after the stopping, with a stepped increase of the electrical voltage.

4. An arrangement for dressing grinding wheels with a diamond dressing tool, comprising means for feeding a dressing tool relative to a grinding wheel to be dressed, and including a piezoelectric element; means for determining a contact between the dressing tool and the grinding wheel to be dressed by measuring an electrical voltage of the piezoelectric element; and means for further feeding the dressing tool relative to the grinding wheel to be dressed for performing the dressing, by applying an electrical voltage to said piezoelectric element, so that said further feeding is performed with a value corresponding to the electrical voltage applied to said piezoelectric element.

5. An arrangement as defined in claim 4; and further comprising means for supporting the dressing tool and including a machine frame arranged so that the dressing tool is supported by said machine frame with interposition of said piezoelectric element.

6. An arrangement as defined in claim 4, wherein said piezoelectric element includes a stack of piezoelectric members.

7. An arrangement as defined in claim 6; and further comprising means for supporting the dressing tool and including a holder immediately connectable with the dressing tool and a machine carriage arranged so that said stack of piezoelectric members is located between said holder and said machine carriage.

* * * * *